United States Patent [19]

Landries et al.

[11] Patent Number: 4,917,635

[45] Date of Patent: Apr. 17, 1990

[54] PIN GRIP TERMINAL

[75] Inventors: Richard V. Landries; Bradley A. Shattuck, both of Warren, Ohio

[73] Assignee: General Motors Corporation, Detroit, Mich.

[21] Appl. No.: 383,486

[22] Filed: Jul. 24, 1989

[51] Int. Cl.[4] ..... H01R 13/432

[52] U.S. Cl. ..... 439/746; 439/749

[58] Field of Search ..... 439/239, 241, 744, 746, 439/747, 749, 830, 871, 872

[56] References Cited

U.S. PATENT DOCUMENTS 3,333,227 7/1967 Dell et al. ..... 439/241

3,777,302 12/1973 Travis ..... 439/749 X 3,995,930 12/1976 Herrmann ..... 439/749 X

*Primary Examiner*—Eugene F. Desmond

*Attorney, Agent, or Firm*—F. J. Fodale

[57] ABSTRACT

A pin grip terminal is disposed in a connector body for engaging a pin contact. The pin grip terminal comprises an elongated base having a concave contact area and a cantilever spring arm which is integrally attached the elongated base by a reverse bend so that the cantilever spring arm confronts the contact area. the cantilever spring arm has a slit which divides the cantilever spring arm into a contact grip for engaging the pin contact and biasing it against the contact area and an elongated lock tang for retaining the pin grip terminal in the connector body.

2 Claims, 1 Drawing Sheet

PRIOR ART

PIN GRIP TERMINAL

BACKGROUND OF THE INVENTION

This invention relates generally to electrical terminals and more specifically to pin grip terminals for use in connector bodies of thermoplastic or other suitable insulation material.

Pin grip terminals for mating with pin contacts have been used for many years. Such terminals generally comprise a base and a cantilever spring arm which extends back over the base so that the base and the cantilever spring arm engage opposite diametrical sides of a pin contact when it is inserted between them. When the pin contact terminals are to be housed and retained in a connector body, it is common practice to form a lock tang at the free end of the cantilever spring arm which cooperates with an internal shoulder of the connector body.

These known pin grip terminals have known drawbacks. The insertion force required to insert the pin grip terminal into the terminal cavity and the engagement force required to insert the pin contact into the pin grip terminal are generally higher than desired. This is generally due to the fact that the insertion and the engagement forces in these pin grip terminals are influenced by the shape of the lock tang and the fit of the lock tang in the terminal cavity of the connector body.

SUMMARY OF THE INVENTION

The object of our invention is to provide an improved pin grip terminal of the above noted type which has lower insertion force and/or engagement force requirements.

A feature of our invention is that our improved pin grip terminal has a pin grip interface which operates substantially independently of a lock tang so that terminal engagement forces are not influenced significantly by the fit of the latch tang in a terminal cavity of a connector body.

Another feature of our invention is that our improved pin grip terminal has a cantilever spring arm which is slit to provide a pin grip interface and a lock tang which operate substantially independently of each other.

Yet another feature of our invention is that our improved pin grip terminal has a cantilever spring arm which is slit to provide a long, narrow lock arm which lowers insertion force requirements considerably.

Other objects and features of our invention will become apparent to those skilled in the art as disclosure is made in the following detailed description of a preferred embodiment of the invention which sets forth the best mode of the invention contemplated by us and which is illustrated in the accompanying sheet of drawing.

DETAILED DESCRIPTION OF THE PREFERRED EMBODIMENT

Figure 1:
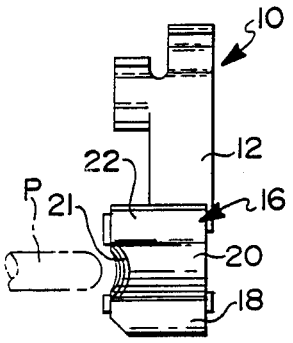
FIG 1 PRIOR ART
FIG. 1 is a side view of a known prior art pin grip terminal.
Figure 2:
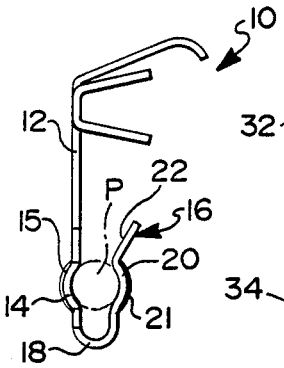
FIG. 2 is a top view of the known prior art pin grip terminal which is shown in FIG. 1.

Referring now to the drawing and particularly to FIGS. 1 and 2, a known prior art pin grip terminal 10 comprises an elongated base 12 which has a concave contact area 14 and a cantilever spring arm 16. The cantilever spring arm 16 is integrally attached to a forward end of the base 12 by a reverse bend 18 so that a concave contact grip 20 of the spring arm 16 confronts the contact area 14 at the forward end of the base 12. The spring arm 16 further includes a lock tang 22 which is integrally connected to the end of the contact grip 20. The lock tang 22, which is relatively short and substantially the same width as the spring arm 16 as shown in FIG. 1, slants away from the base 12 in the rearward direction as shown in FIG. 2.

The prior art pin grip terminal 10 is designed to mate to a pin contact P which is inserted into the space between the concave contact area 14 and the concave contact grip 20 where the pin contact P is engaged on opposite diametrical sides and tightly gripped as determined by the self biasing forces of the cantilever spring arm 16. The concave contact area 14 and the concave contact grip 20 have their respective upper edges 15, 21 flared outwardly in order to facilitate insertion of the pin contact P.

Figure 3:
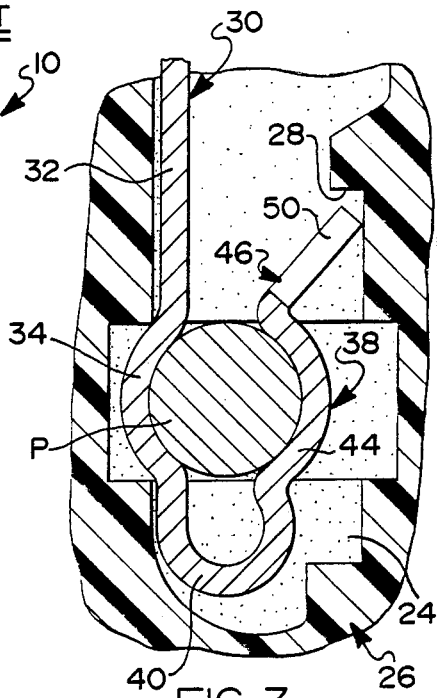
FIG. 3 is a fragmentary sectional view showing a pin grip terminal in accordance with our invention disposed in a terminal cavity of a connector body. The sectional view of the pin grip terminal is taken substantially along the line 3—3 of FIG. 4 looking in the direction of the arrows.

The prior art pin grip terminal 10 is usually disposed in a terminal cavity of a connector body which has an internal lock shoulder, such as the terminal cavity 24 of connector body 26 which has internal lock shoulder 28 and which is shown in FIG. 3 in conjunction with our improved pin grip terminal 30.

When the prior art pin grip terminal 10 is inserted into such a terminal cavity, the required insertion forces are usually quite high because the full width lock tang 22 is relatively rigid and consequently the entire spring arm 16 must be depressed in order for the lock tang 22 to snap past the lock shoulder 28. Moreover, if the lock tang bottoms out on a wall of the cavity, the engagement forces required to insert the pin terminal P into the space between the base 12 and the spring arm 16 will be increased because the spring arm 16 now acts more in the nature of a simple beam rather than a cantilever.

Figure 4:
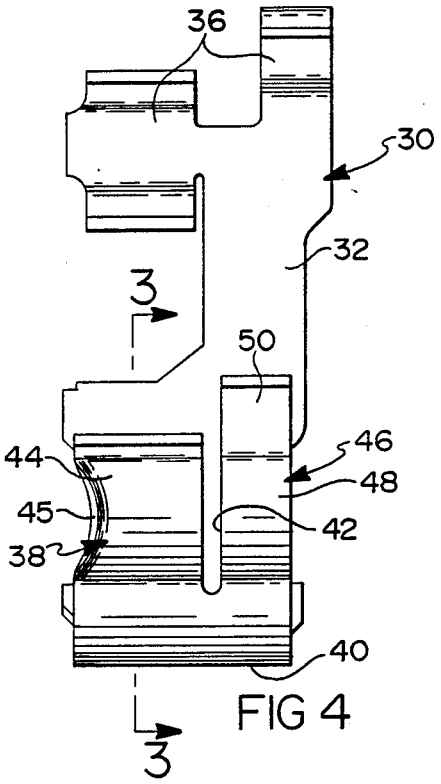
FIG. 4 is a side view of the pin grip terminal which is shown in FIG. 3.
Figure 5:
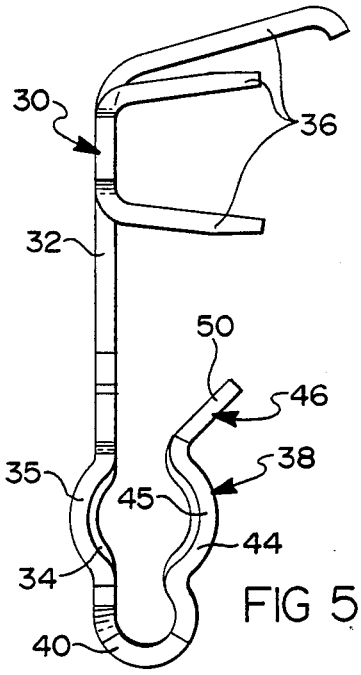
FIG. 5 is a top view of the pin grip terminal which is shown in FIGS. 3 and 4.

The pin grip terminal 30 in accordance with our invention is illustrated in FIGS. 3, 4 and 5. The terminal 30 is designed for use in the connector body 26 of electrical insulation material which has a terminal cavity 24 which includes a lock shoulder 28 as shown in FIG. 3.

The pin grip terminal 30 comprises an elongated base 32 which has a forward end, a concave contact area 34 at the forward end for engaging a side of a contact pin P (as shown in FIG. 3), a rearward end and crimpable portions 36 at the rearward end for attaching the pin grip terminal 30 to a conductor (not shown). The pin grip terminal 30 further comprises a cantilever spring arm 38 which is integrally attached to the forward end of the elongated base 32 by a reverse bend 40 so that the cantilever spring arm 38 confronts the contact area 34 at the forward end of the elongated base 32 as best seen in FIGS. 3 and 5.

The cantilever spring arm 38 has a slit 42 which extends from a position partway into the reverse bend 40 to a free end of the cantilever spring arm 38 as best shown in FIG. 4. The slit 42 divides the cantilever spring arm 32 into an upper concave contact grip 44 and a lower elongated lock tang 46 which act substantially independently of each other.

The concave contact grip 44 engages a opposite side of the pin contact P and bias it against the concave contact area 34 at the forward end of the elongated base 32 as shown in FIG. 3. The concave contact area 34 and the concave contact grip 44 have their respective upper edges 35, 45 flared outwardly, as shown in FIGS. 4 and 5, in order to facilitate insertion of the pin contact P into the space between the concave contact area 34 and the concave contact grip 44.

The elongated lock tang 46 has a concave portion 48 which is aligned with the concave contact grip 44 and a straight portion 50 which is integrally attached to the concave portion 48. The straight portion 50 which extends past the concave contact grip 44 and slants away from the elongated base 32 in the rearward direction cooperates with the shoulder 28 to retain the pin grip terminal 30 in the terminal cavity 24 of the connector body 26.

The width of the contact grip 44 is a major portion (about 60%) of the width of the spring arm 38 while the width of the lock tang 46 is a minor portion (about 30%) so that the contact grip 44 provides most of the contact force against the pin contact P. It should be noted that the contact grip 44 of the spring arm 38 terminates substantially at the end of the contact grip 44 so that contact grip 44 is well spaced from the side wall of the terminal cavity 24. Moreover as noted above, the contact grip 44 acts substantially independently of the elongated tang 46. Hence, the engagement force requirements for inserting the pin contact P are not influenced by the fit of the pin grip terminal 30 in the terminal cavity 24 in a significant way.

It should also be noted that the lock tang 46 is relatively long as well as narrow and therefore relatively flexible due to the presence of the slit 42. Consequently the insertion force requirements for snapping the lock tang 46 past the lock shoulder 28 are also significantly reduced in comparison to the prior art pin grip terminal 10.

Of course, the length and location of the slit 42 can be varied in order to achieve desired engagement force and insertion force requirements. In other words we wish it to be understood that we do not desire to be limited to the exact details of construction shown and described, for obvious modifications will occur to a person skilled in the art.

The embodiments of the invention in which an exclusive property or privilege is claimed are defined as follows:

1. A pin grip terminal for use in a connector body of electrical insulation material which has a terminal cavity which includes a latch shoulder, the pin grip terminal comprising:

a base having a forward end, a contact area at the forward end for engaging a side of pin contact and a rearward end, and a cantilever spring arm which is integrally attached to the forward end of the base by a reverse bend so that the cantilever spring arm confronts the contact area at the forward end of the base, the cantilever spring arm having a slit which divides the cantilever spring arm into a contact grip for engaging an opposite side of the pin contact and biasing it against the contact area at the forward end of the base and an elongated lock tang for retaining the pin grip terminal in a connector body, the elongated lock tang slanting away from the base in the rearward direction and extending past the contact grip.

2. A pin grip terminal for use in a connector body of electrical insulation material which has a terminal cavity which includes a latch shoulder, the pin grip terminal comprising:

an elongated base having a forward end, a concave contact area at the forward end for engaging a side of a pin contact, a rearward end and means at the rearward end for attaching the pin grip terminal to a conductor, and a cantilever spring arm which is integrally attached to the forward end of the elongated base by a reverse bend so that the cantilever spring arm confronts the contact area at the forward end of the elongated base, the cantilever spring arm having a slit which extends from the reverse bend to a free end of the cantilever spring arm to divide the cantilever spring arm into a concave contact grip for engaging a opposite side of the pin contact and biasing it against the concave contact area at the forward end of the elongated base and an elongated lock tang for retaining the pin grip terminal in a connector body which acts independently of the concave contact grip, the concave contact grip having a width which is a major portion of the width of the spring arm, and the elongated lock tang having a concave portion which is aligned with the concave contact grip and a straight portion which extends past the concave contact grip and slants away from the elongated base in the rearward direction.

* * * * *